US006940413B2

(12) United States Patent
Longobardi

(10) Patent No.: US 6,940,413 B2
(45) Date of Patent: Sep. 6, 2005

(54) METHOD AND APPARATUS FOR MONITORING OPERATION OF ELECTRICAL HOUSEHOLD APPLIANCES

(75) Inventor: Roberto Longobardi, Rome (IT)

(73) Assignee: International Business Machines Corporation, Armonk, NY (US)

( * ) Notice: Subject to any disclaimer, the term of this patent is extended or adjusted under 35 U.S.C. 154(b) by 196 days.

(21) Appl. No.: 10/358,453

(22) Filed: Feb. 4, 2003

(65) Prior Publication Data

US 2003/0156034 A1 Aug. 21, 2003

(30) Foreign Application Priority Data

Feb. 15, 2002 (EP) ..... 02368016

(51) Int. Cl.[7] ..... G08B 17/00

(52) U.S. Cl. ..... 340/635; 340/657; 340/661; 340/663; 324/510; 324/511

(58) Field of Search ..... 340/635, 657, 340/661, 663; 324/500, 510, 511; 361/1

(56) References Cited

U.S. PATENT DOCUMENTS 4,429,576 A * 2/1984 Norris ..... 73/636
6,526,516 B1 * 2/2003 Ishikawa et al. ..... 713/340

* cited by examiner

*Primary Examiner*—Julie Bichngoc Lieu
(74) *Attorney, Agent, or Firm*—Ido Tuchman; E. Dwayne Nelson

(57) ABSTRACT

Discloses is a method and a corresponding apparatus for monitoring operation of electrical household appliances (such as a freezer). The method includes checking the temperature inside the freezer on a periodical basis and comparing with a de-frosting temperature. A critical condition is detected and recorded when the temperature inside the freezer stays over the de-frosting temperature for a period longer than a threshold value. In this way, when a user returns home after several days of absence, he or she is informed whether the food has been de-frozen and then frozen again because of a outage in the power supply network.

14 Claims, 5 Drawing Sheets

METHOD AND APPARATUS FOR MONITORING OPERATION OF ELECTRICAL HOUSEHOLD APPLIANCES

FIELD OF THE INVENTION

The present invention relates to the domestic environment, and in particular to a method and apparatus for monitoring operation of electrical household appliances.

BACKGROUND OF THE INVENTION

An ever-increasing number of electrical household appliances are commonly employed in every domestic environment. The correct operation of most appliances is very important, particularly when nobody is at home (such as during a vacation).

For example, a prolonged outage in a power supply network feeding the appliances may bring about serious damages. A typical problem is that of a freezer containing frosted food. In this case, the food may be defrosted during the outage and then frozen again when the power supply is restored; as a consequence, the food is no more suitable for eating. However, a user returning home after several days of vacation is completely unaware of the situation, with serious risks of poisoning.

Several types of devices for detecting outages in the powers supply network have been proposed in the last years. All the devices known in the art trigger an alarm when the outage is detected; for example, a warning LED is switched on, so as to inform the user that an outage has occurred when he or she was not at home.

A drawback of the solutions known in the art is that they are completely ineffective in monitoring operation of the appliances. Particularly, no information is provided to the user about any critical condition that may have occurred during his or her absence.

SUMMARY OF THE INVENTION

A feature of the present invention provides a method and a corresponding apparatus for monitoring operation of electrical household appliances.

It is another feature of the present invention to inform the user of any critical condition that has occurred during his or her absence.

The accomplishment of these and other related objects is achieved by a method of monitoring operation of an electrical household appliance including the steps of: collecting at least one operative parameter relating to operation of the electrical household appliance, verifying whether the at least one operative parameter is indicative of a critical condition defined according to a predetermined criterion, and recording an indication of the critical condition when the result of the verification is positive.

The present invention also provides a computer program for performing the method. Furthermore, the present invention provides a corresponding apparatus, and an electrical household appliance including the apparatus.

The novel features believed to be characteristic of this invention are set forth in the appended claims. The invention itself, however, as well as these and other related objects and advantages thereof, will be best understood by reference to the following detailed description to be read in conjunction with the accompanying drawings.

DETAILED DESCRIPTION OF THE PREFERRED EMBODIMENT

Figure 1A:
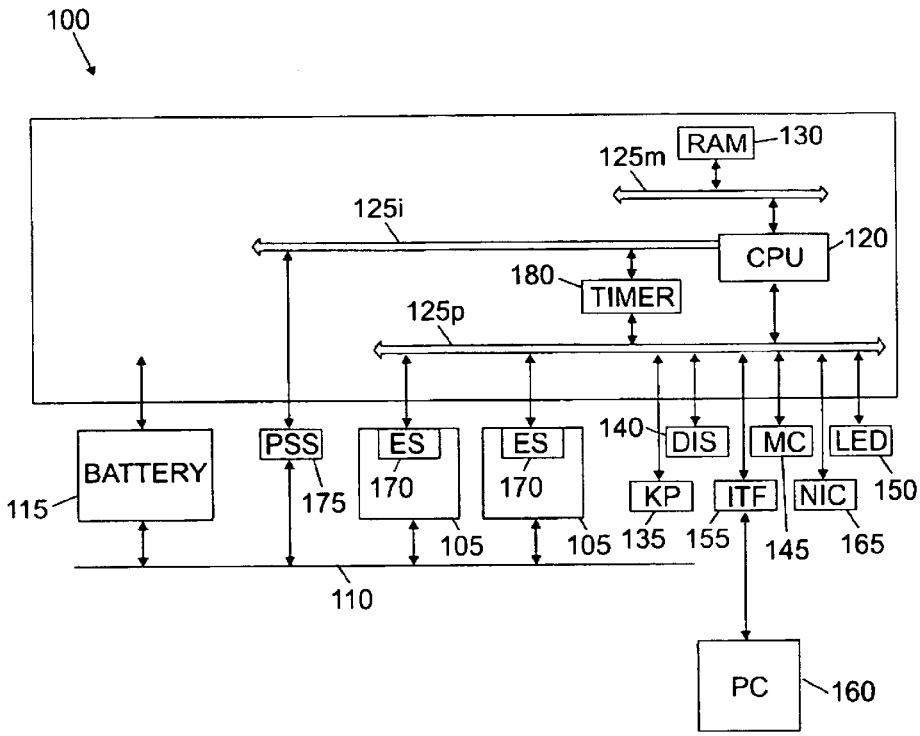
FIG. 1*a* is a schematic block diagram of a system in which the method of the invention can be used.

With reference in particular to FIG. 1*a,* an apparatus 100 for monitoring operation of a series of electrical household appliances 105 (such as a freezer, a refrigerator, an air conditioning system, and the like) is shown. The appliances 105 are fed by a power supply network 110 of a domestic environment.

A battery pack 115 (recharged by the power supply network 110) is used for feeding the different units of the monitoring apparatus 100. Particularly, operation of the monitoring apparatus 100 is controlled by a central processing unit (CPU) 120. A memory bus 125*m* couples the CPU 120 with a RAM 130, which is used directly by the CPU 120 as a working memory.

Several peripheral units are connected in parallel to an input/output (I/O) bus 125*p* (for communicating with the CPU 120). In detail, the monitoring apparatus 100 includes a keypad (KP) 135, a display (DIS) 140, a driver for reading/writing a flash memory card (MC) 145, and an alarm LED 150. An external interface (ITF) 155, such as of the USB type, is used to connect a Personal Computer (PC) 160 with the monitoring apparatus 100; moreover, a network Interface Card (NIC) 165 allows remote access to the monitoring apparatus 100 (by means of a telephone network). A series of environmental sensors (ES) 170 collect one or more parameters relating to operation of each appliance 105, such as a temperature inside the freezer or the refrigerator, a room temperature and humidity, and the like.

A sensor (PSS) 175 detects any outage and recovery in the power supply network 110. The power supply sensor 175 sends a corresponding outage interrupt and a corresponding recovery interrupt to the CPU 120 by means of an interrupt bus 125*i*. A timer 180 is further coupled to the CPU 120; the timer 180 sends a sampling interrupt (for example, every minute) through the interrupt bus 125*i* and provides the current time through the I/O bus 125*p*.

Figure 1B:
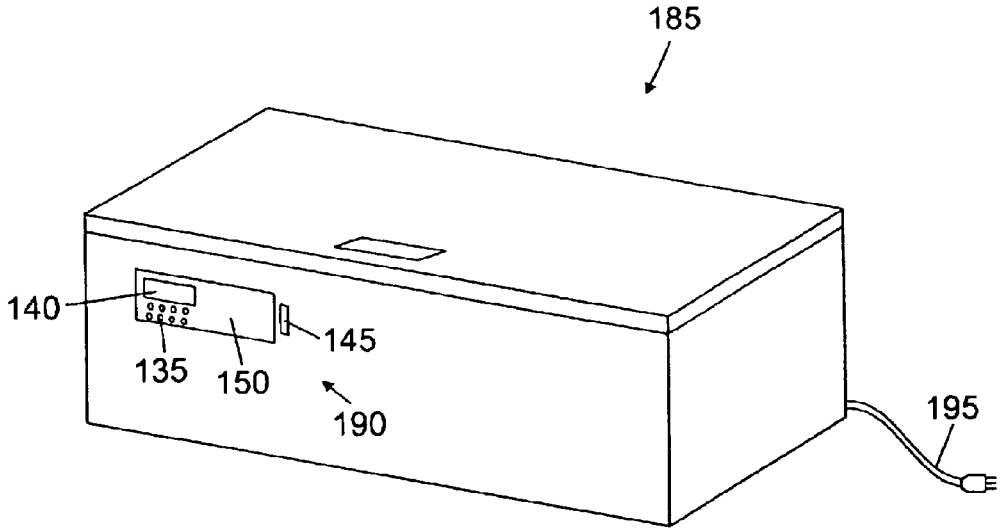
FIG. 1*b* depicts a freezer including an apparatus for monitoring its operation.

In a different embodiment of the present invention (as shown in FIG. 1*b*) each appliance, such as a freezer 185, embeds a dedicated monitoring apparatus 190. The monitoring apparatus 190 has a structure similar to the one described above (the corresponding elements are denoted with the same references, and their explanation is omitted for the sake of simplicity). Particularly, the environmental sensor measures the temperature inside the freezer 185, whereas the power supply sensor is directly connected to an input electric cable 195 of the freezer 185. The keypad 135, the display 140, the flash memory card 145, and the alarm LED 150 are accessible on a frontal panel of the freezer 185.

Similar considerations apply if the monitoring apparatus is replaced with an equivalent data processing system, if the monitoring apparatus has a different structure or includes other units (for example, if the external interface is of the serial or parallel type, if the flash memory card, the NIC and/or the external interface are not provided), if the apparatus is used for monitoring operation of different appliances, if different operative parameters are collected, if two or more power supply sensors are employed, if the sampling period has a different value or is customised by a user, and the like.

Figure 2:
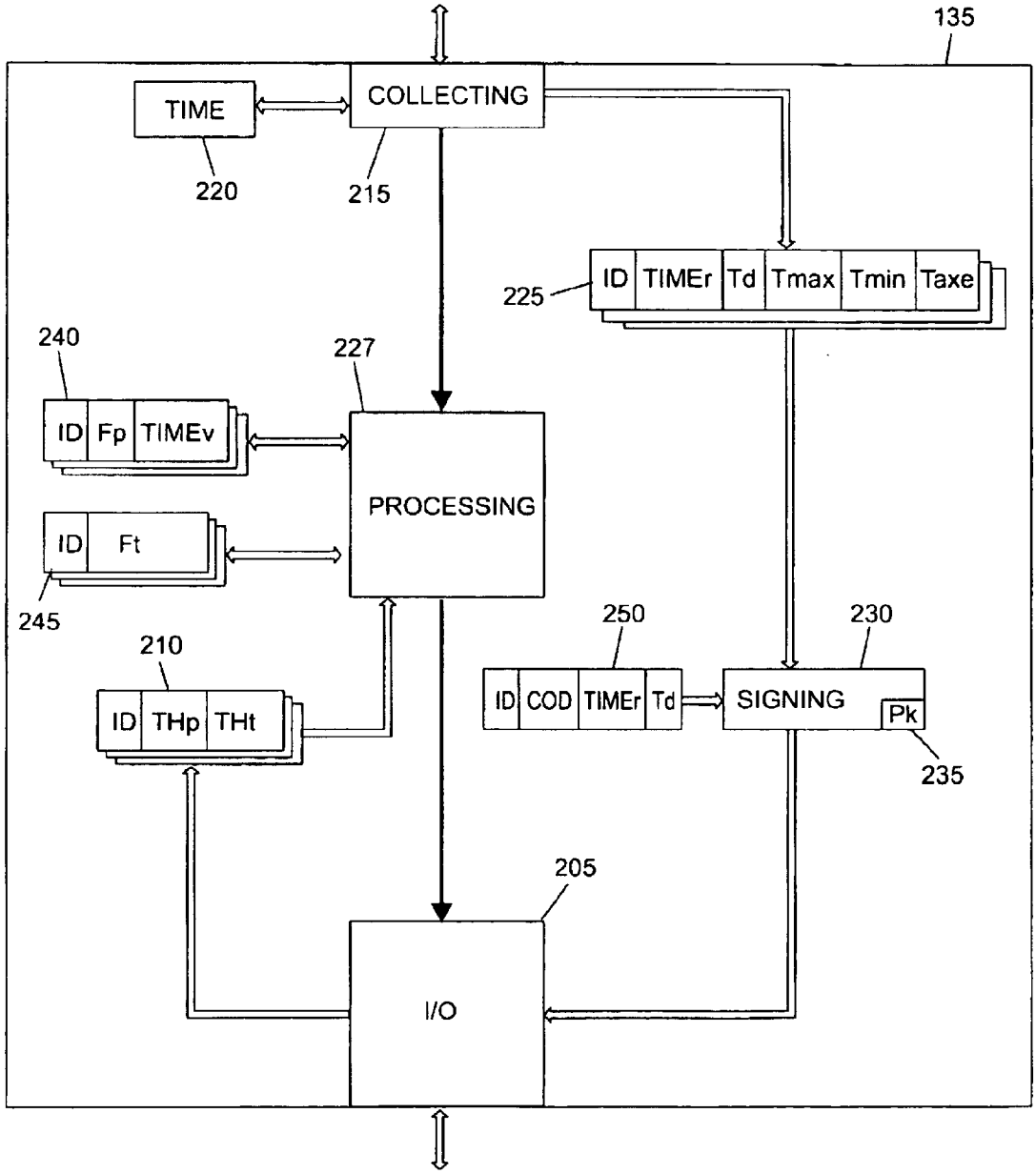
FIG. 2 shows a partial content of a working memory of an apparatus used to monitor operation of household appliances.

With reference to FIG. 2, a partial content of the working memory 135 of the monitoring apparatus in operation is shown; the information (programs and data) is typically stored on the flash memory card and loaded (at least partially) into the working memory when the programs are running.

An input/output (I/O) interface 205 is used to enter data and/or commands (with the keypad) and to drive the display. The I/O interface 205 controls the flash memory card, the NIC and the external interface of the monitoring apparatus. The I/O interface 205 manages the updating of a table 210, which is formed by a record (accessed through a respective identifier ID) for each appliance. The record stores a parameter threshold value THp and a time threshold value Tht. For example, the parameter threshold value THp is set to a de-frosting temperature (e.g. 0° C.), and the time threshold value THt is set to the maximum acceptable length (e.g. 90 minutes) of a period during which the temperature inside the freezer may stay over the threshold value THp without causing the de-frosted food contained in the freezer from becoming un-safe for eating.

A collecting module 215 receives the outage interrupts, the recovery interrupts, and the sampling interrupts. In response to the sampling interrupt, the collecting module 215 detects the current time that is stored in a variable 220. Moreover, a record for a corresponding observation event is added to a log 225 for each appliance. The record includes the appliance identifier ID, a recording time TIMEr (set to the current time), a collected parameter Td (provided by the environmental sensor), a maximum parameter Tmax, a minimum parameter Tmin, and an average parameter Tave for the appliance. The collecting module 215 further notifies a processing module 227 of an outage event (in response to the outage interrupt) and of a recovery event (in response to the recovery interrupt).

Each new observation record added to the log 225 is supplied to a signing module 230, which embeds a private key Pk of a provider of the monitoring apparatus (stored in a respective variable 235). The signing module 230 calculates a digital signature of the observation record (for example, applying the RSA algorithm). The observation record and the corresponding digital signature are provided to the I/O interface 205 (in order to be stored on the flash memory card, transmitted on the telephone network, or provided to the external PC).

The new observation record is also supplied to the processing module 227. The processing module 227 controls two tables 240 and 245 including a record (accessed through the respective identifier ID) for each appliance. The record of the table 240 stores a flag Fp, which is asserted to indicate a parameter violation event (when the collected parameter Td exceeds the parameter threshold value THp) and it is deasserted to indicate a parameter restoration event (when the collected parameter Td falls below the parameter threshold value Thp). Moreover, the record stores the time TIMEv associated with occurrence of the parameter violation event. The record of the table 245 consists of a further flag Ft indicative of a time violation event (when the collected parameter Td stays above the parameter threshold value THp for a period longer than the time threshold value THt).

The processing module 227 directly interacts with the I/O interface 205. Moreover, the processing module 227 generates a record 250 for every event (different from the observation event) that has occurred (i.e., parameter violation event, parameter restoration event, time violation event, outage event or recovery event). The event record 250 includes the appliance identifier ID, a code COD indicative of the event type, and the corresponding recording time TIMEr and collected parameter Td. The event record 250 is supplied to the signing module 230 (in order to be provided to the I/O interface 205 with the corresponding digital signature).

Similar considerations apply if the programs and data are structured in a different manner (for example, with simplified memory structures when the apparatus is embedded in a single appliance), if the tables are replaced with equivalent memory structures, if the records have a different format, if the records are signed using another algorithm, and the like.

Figure 3A:
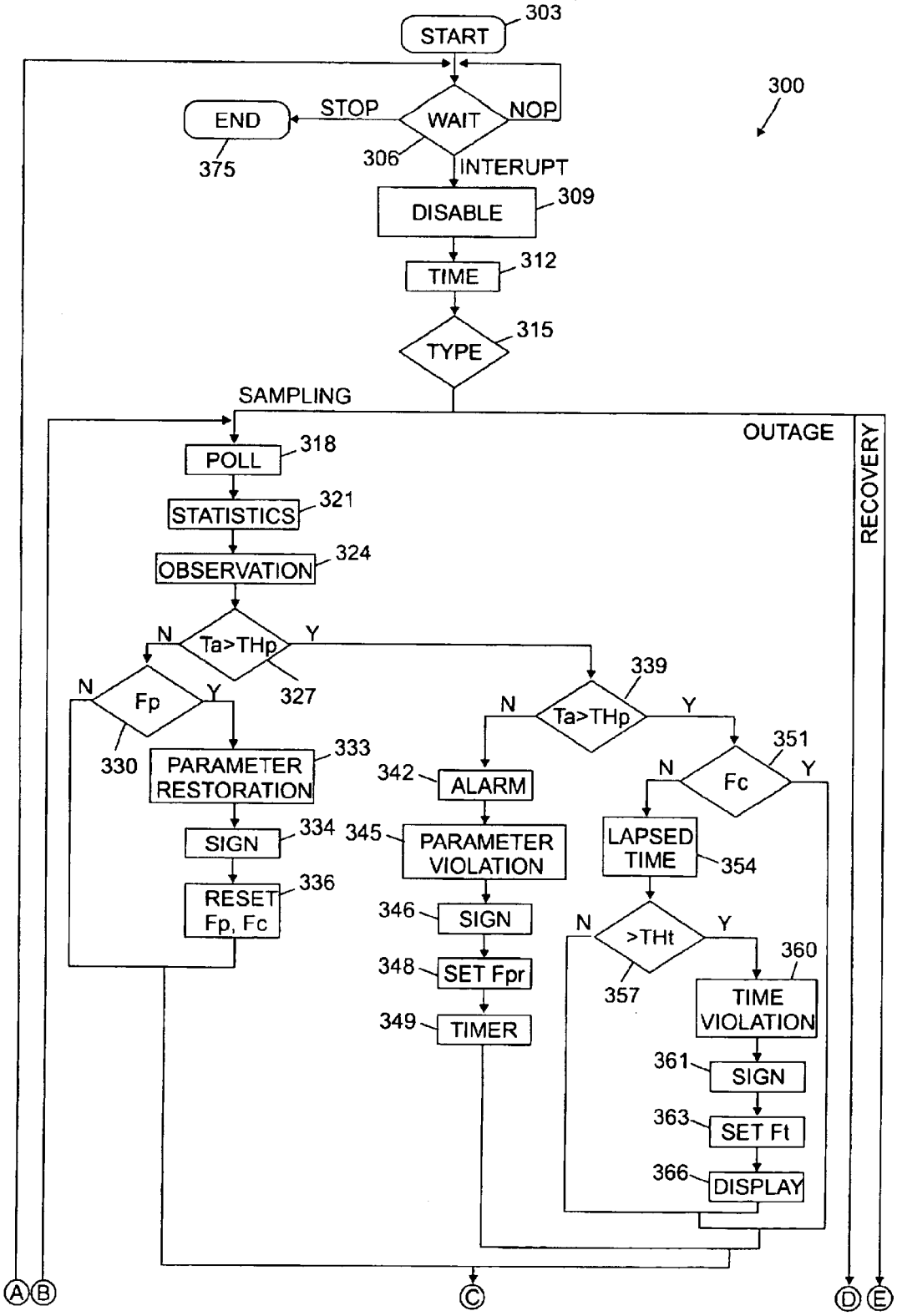
FIGS. 3*a*–3*b* are a flowchart describing the logic of a method used for monitoring operation of the electrical household appliances.
Figure 3B:
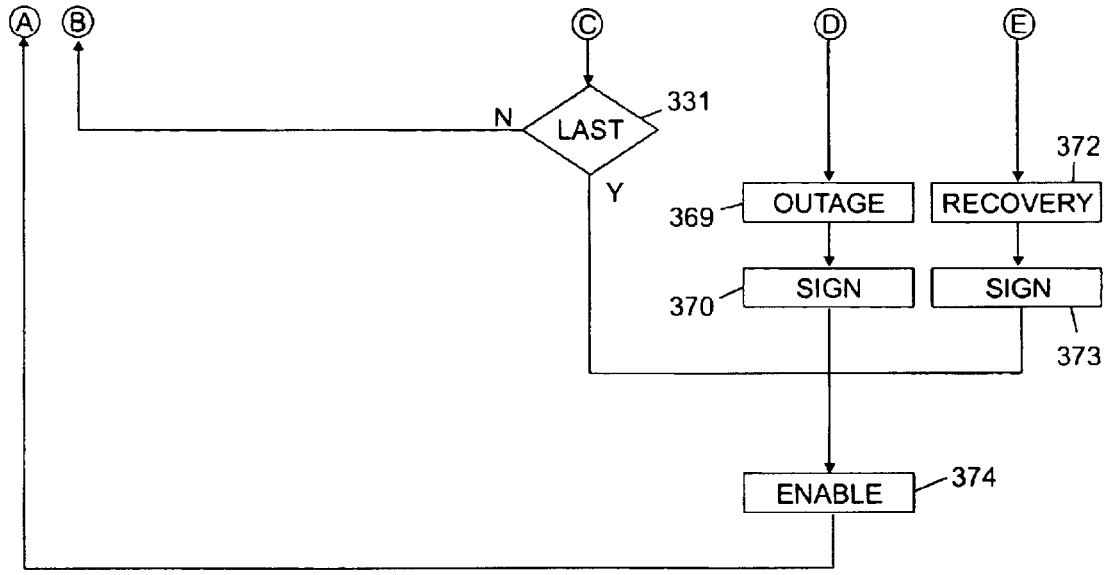

As shown in FIGS. 3*a*–3*b*, whenever the monitoring apparatus is turned on, a method 300 is performed. The method starts at block 303, and enters an idle loop at block 306. Whenever an interrupt is received (sampling interrupt, outage interrupt or recovery interrupt), the method executes the blocks 309–374 and then returns to block 306; conversely, when the monitoring apparatus is shut down, the method ends at the final block 375.

Considering now block 309, all the interrupts are disabled. The current time is gathered from the timer and stored on the respective variable at block 312. A test is made in decision block 315 to determine the type of interrupt. The blocks 318–366 are executed in response to the sampling interrupt, the blocks 369–370 are executed in response to the outage interrupt, and the blocks 372–373 are executed in response to the recovery interrupt; in every case, the interrupts are enabled at block 374 and the method then returns to block 306.

When a sampling interrupt is received, the environmental sensor associated with a first appliance is polled at block 318, in order to collect the corresponding parameter Td. The method passes to block 321, wherein the new maximum parameter Tmax, the new minimum parameter Tmin, and the new average parameter Tave for the current appliance are calculated (exploiting the parameter Td just collected and the ones stored in the respective records of the log). Continuing to block 324, a new observation record is generated; the observation record is then added to the log, signed and stored on the flash memory card.

The processing module verifies at block 327 whether the collected parameter Td has reached the parameter threshold value THp. If not, a test is made in decision block 330 to determine whether the parameter violation flag Fp is asserted. If the parameter violation flag Fp is deasserted, the method descends into block 331 (described in the following). Conversely, a record for the parameter restoration event is generated at block 333, and the event record is signed and stored on the flash memory card at block 334. Continuing to block 336, the parameter violation flag Fp and the time violation flag Ft are deasserted. The method then descends into block 331.

Referring back to block 327, if the collected parameter Td has reached the parameter threshold value THp the method continues to decision block 339. The parameter violation flag Tp is checked. The blocks 342–349 are executed when the parameter violation flag Fp is deasserted, whereas the blocks 351–366 are executed otherwise. In both cases, the method then descends into block 331.

Considering block 342 (parameter violation flag THp deasserted), the alarm LED is activated. The method then passes to block 345, wherein a record for the parameter violation event is generated; continuing to block 346, the event record is signed and stored on the flash memory card. The parameter violation flag Fp is asserted at block 348, and the corresponding violation time TIMEv is set to the current time at block 349.

With reference now to block 351 (parameter violation flag THp asserted), the method checks whether the time violation flag Fp is asserted. If so, the method descends into block 331 directly. On the contrary, the period lapsed from the violation time TIMEv is calculated at block 354. The lapsed period is compared with the time threshold value THt at block 357. If the lapsed period is lower than the time threshold value THt, the method descends into block 331 directly. Conversely, when the lapsed period has reached the time threshold value THt a record for the time violation event is generated at block 360; continuing to block 361, the event record is signed and stored on the flash memory card. The time violation flag Ft is asserted at block 363, and a corresponding warning message is shown on the display of the monitoring apparatus at block 366. The method then continues to block 331.

Considering now block 331, a test is made to verify whether the last appliance has been processed. If not, the method returns to block 318 for repeating the operations described above on a next appliance. Conversely, the method descends into block 374.

When an outage interrupt is received (block 315), a corresponding record for the outage event is generated at block 369. The method then continues to block 370, wherein the event record is signed and stored on the flash memory card. On the other hand, when a recovery interrupt is received a corresponding record for the recovery event is likewise generated at block 372, and the event record is signed and stored on the flash memory card at block 373.

The monitoring apparatus behaviour will be now described with reference to a typical situation, in which a user leaves his or her home for a vacation period. The user activates the monitoring apparatus before leaving. When the user returns home after several days, if the alarm LED is off, he or she is sure that no critical condition has occurred during the absence. On the contrary, the alarm LED (when on) informs the user that a parameter violation event has occurred (e.g. the temperature inside the freezer has risen above 0° C. because of an outage in the power supply network). If the display shows a warning message for a time violation event, the user is further informed that the outage has lapsed for a period long enough to damage the food in the freezer. As a consequence, the food is no more suitable for eating, even if it has been frozen again when the power supply has been restored. As a consequence, all the food in the freezer will be thrashed so as to prevent any risk of poisoning.

Similar considerations apply if an equivalent method is performed (for example, with a simplified flow when the apparatus is embedded in a single appliance), if the interrupts are served in a different manner, if equivalent information is recorded, if the outage and recovery events are detected with a different mechanism (for example, periodically polling the power supply sensors), if equivalent statistical information is calculated and recorded, if the recorded information is signed by another trusted entity (such as a power supply provider), and the like.

More generally, the present invention provides a method of monitoring operation of an electrical household appliance. The method involves the collection of one or more operative parameters relating to operation of the electrical household appliance. The method then verifies whether the operative parameters are indicative of a critical condition defined according to a predetermined criterion. An indication of the critical condition is recorded when the result of the verification is positive.

The devised solution is effective in monitoring operation of electrical household appliances.

Moreover, the method of the invention enables the user to be informed of any critical condition that has occurred during his or her absence.

For example, the proposed solution prevents the user from eating food that has been de-frosted and then frozen again. In this way, any risk for his or her health may be avoided in a very simple manner.

The preferred embodiment of the invention described above offers further advantages.

Particularly, the critical condition is detected when the operative parameter exceeds a threshold value for a period longer than a predetermined time.

This criterion is particular advantageous for detecting hazardous situations caused by a prolonged outage in the power supply network.

Preferably, the operative parameter is collected periodically and the critical condition is detected employing a flag that is asserted when the operative parameter reaches the threshold.

The proposed algorithm is very simple, but at the same time effective.

Alternatively, a different algorithm is employed for detecting the critical condition (for example, discarding the collected operative parameters when their distance from the current average exceeds a predetermined value, so as to filter any noise), the operative parameter is not collected periodically (for example, it is collected only when the power supply is restored), or the critical condition is defined with a different criterion (for example, when the average humidity reaches a threshold value).

As a further improvement, the method also records parameter violation events and parameter restoration events.

This feature provides a log of data and events, which can be browsed by the user when returning home.

Moreover, one or more statistical values for the operative parameter are calculated and recorded.

This information is very useful, particularly for generating several types of reports.

In a preferred embodiment of the invention, outage events and recovery events are also recorded.

These additional events may be used to analyse the cause of the critical condition.

In addition, the recorded information is digitally signed.

This guarantees that the gathered information has not been altered or manipulated; therefore, it can be taken as evidence against the power supply provider or an insurance company.

However, the solution of the invention leads itself to be implemented even without recording any parameter violation event and parameter restoration event, without calculating any statistical information, without recording any outage event and recovery event, or without digitally signing the recorded information.

In a preferred embodiment of the invention, the appliance is a freezing device and the operative parameter is the temperature inside the device.

This application makes it possible to prevent the most common risks connected with the outages of the power supply network (even if different applications are contemplated and within the scope of the invention).

Advantageously, the solution according to the present invention is implemented with a computer program (software), which is provided on the flash memory card.

Alternatively, the program is stored on an equivalent computer readable medium (such as a ROM), or more generally is provided in any other form directly loadable into a working memory of the monitoring apparatus. However, the method according to the present invention leads itself to be carried out even with a hardware structure (for example, integrated in a chip of semiconductor material).

In addition, it should be noted that the monitoring apparatus for carrying out the method of the invention is suitable to be implemented either as a stand-alone product for monitoring one or more appliances or as a feature embedded in each appliance.

Naturally, in order to satisfy local and specific requirements, a person skilled in the art may apply to the solution described above many modifications and alterations all of which, however, are included within the scope of protection of the invention as defined by the following claims.

What is claimed is:

1. A method of monitoring operation of an electrical household appliance including the steps of:

collecting at least one operative parameter relating to operation of the electrical household appliance, verifying whether the at least one operative parameter is indicative of a critical condition defined according to a predetermined criterion, recording an indication of the critical condition when the result of the verification is positive, and providing the electrical household appliance as a freezing device and the at least one operative parameter is a temperature inside the freezing device.

2. The method according to claim 1, further comprising the step of defining the critical condition as a period during which the at least one operative parameter exceeds a threshold value, the period being longer than a further threshold value.

3. The method according to claim 2, wherein the at least one operative parameter is collected periodically, the step of verifying whether the at least one operative parameter is indicative of the critical condition including for each collection of the at least one operative parameter:

if the at least one operative parameter exceeds the threshold value:

asserting a flag indicative of a threshold violation and storing a time associated with the threshold violation if the flag is deasserted, and detecting the critical condition if the flag is asserted and the period lapsed from the stored time exceeds the further threshold, and if the at least one parameter does not exceed the threshold value deasserting the flag.

4. The method according to claim 3, further comprising the steps of:

recording an indication of the threshold violation when the at least one parameter exceeds the threshold value and the flag is deasserted, and recording an indication of a threshold restoration when the at least one parameter does not exceed the threshold value and the flag is asserted.

5. The method according to claim 1, further comprising the steps of:

calculating at least one statistical value for the at least one operative parameters, and recording the at least one statistical value.

6. The method according to claim 1, further comprising the steps of:

recording an indication of an interruption in a power supply feeding the electrical household appliance in response to the detection of the interruption, and recording an indication of a restoration of the power supply in response to the detection of the restoration.

7. The method according to claim 6, further comprising the step of digitally signing the indication of the critical condition, the indication of the interruption and the indication of the restoration with a private key of a trusted entity.

8. A computer program directly loadable into a working memory of a data processing system for performing the method of claim 1 when the program is run on the data processing system.

9. A program product comprising a computer readable medium on which the program of claim 8 is stored.

10. An apparatus for monitoring operation of at least one electrical household appliance including means for collecting at least one operative parameter relating to operation of each electrical household appliance, means for verifying whether the at least one operative parameter is indicative of a critical condition defined according to a predetermined criterion, and means for recording an indication of the critical condition when the result of the verification is positive, wherein the electrical household appliance is a freezing device and the at least one operative parameter is a temperature inside the freezing device.

11. The apparatus according to claim 10, wherein the at least one electrical household appliance consists of a plurality of electrical household appliances, the apparatus including a single logic unit coupled to the electrical household appliances and including the means for verifying and the means for recording.

12. The apparatus according to claim 10, wherein the at least one electrical household appliance consists of a single electrical household appliance, the apparatus being embedded in the electrical household appliance.

13. A computer program product embodied in a tangible media comprising:

computer readable program codes coupled to the tangible media for monitoring operation of a freezing device, the computer readable program codes configured to cause the program to:

collecting a temperature inside the freezing device;

verifying whether the temperature inside the freezing device is indicative of a critical condition defined according to a predetermined criterion; and recording an indication of the critical condition when the result of the verification is positive.

14. The computer program product according to claim 13, wherein critical condition is a period of time during which the temperature inside the freezing device exceeds a threshold value.

* * * * *